US005699670A

United States Patent [19]

Jurewicz et al.

[11] Patent Number: 5,699,670

[45] Date of Patent: Dec. 23, 1997

[54] CONTROL SYSTEM FOR A CRYOGENIC REFRIGERATION SYSTEM

[75] Inventors: Romuald Martin Jurewicz, St. Louis Park; Herman H. Viegas, Bloomington, both of Minn.

[73] Assignee: Thermo King Corporation, Minneapolis, Minn.

[21] Appl. No.: 745,902

[22] Filed: Nov. 7, 1996

[51] Int. Cl.[6] ..... F17C 9/04

[52] U.S. Cl. ..... 62/50.3; 62/186

[58] Field of Search ..... 62/50.2, 50.3, 62/156; 165/64

[56] References Cited

U.S. PATENT DOCUMENTS

| | | | |
|---|---|---|---|
| 5,267,443 | 12/1993 | Roehrich et al. | 62/50.3 |
| 5,285,644 | 2/1994 | Roehrich et al. | 62/50.3 |
| 5,287,705 | 2/1994 | Roehrich et al. | 62/50.3 |
| 5,305,825 | 4/1994 | Roehrich et al. | 165/64 |
| 5,311,927 | 5/1994 | Taylor et al. | 165/64 |
| 5,313,787 | 5/1994 | Martin | 62/50.3 |
| 5,320,167 | 6/1994 | Johnson et al. | 165/64 |
| 5,365,744 | 11/1994 | Viegas et al. | 62/50.3 |
| 5,458,188 | 10/1995 | Roechrich et al. | 165/64 |
| 5,598,709 | 2/1997 | Viegas et al. | 62/50.2 |

*Primary Examiner*—Christopher Kilner

[57] ABSTRACT

A control system is provided for a cryogenic refrigeration system having an evaporator-heater coil, an electronically controlled valve for regulating the amount of cryogenic gas to the coil, and a vapor motor powered by the cryogenic gas that drives both an alternator for recharging the system battery, and a fan for generating an air flow through the coil and into a conditioned space. The control system includes a temperature sensor for generating an electrical signal indicative of the temperature of the conditioned space, and a microprocessor that is electrically connected to the temperature sensor, the alternator, and the electronically controlled valve for modulating the flow of cryogenic gas through the evaporator-heater coil in said vapor motor to achieve a selected set point temperature in the conditioned space, and to maintain a sufficient alternator current to effectively recharge the system battery.

20 Claims, 1 Drawing Sheet

CONTROL SYSTEM FOR A CRYOGENIC REFRIGERATION SYSTEM

BACKGROUND OF THE INVENTION

This invention is generally concerned with control systems, and is specifically concerned with a control system for use with a cryogenic refrigeration system of a type having a gas powered motor for driving both an alternator for recharging the system battery, and a fan for blowing air through an evaporator-heater coil.

Air conditioning and refrigeration systems conventionally utilize a chlorofluorocarbon (CFC) refrigerant in a mechanical refrigeration cycle. Because of the suspected depleting effect of CFCs of stratospheric ozone ($O_3$), practical alternatives to the use of CFCs in air conditioning and refrigeration systems are being sought. One such alternative is a cryogenic refrigeration system utilizing either liquid carbon dioxide or liquid nitrogen. Such a system is particularly attractive because, in addition to eliminating the need for CFC refrigerants, it also eliminates the need for a refrigerant compressor and the diesel engine or other prime mover that drives it.

An example of such a cryogenic refrigeration system is described and claimed in U.S. patent application Ser. No. 08/501,372, filed Jul. 12, 1995, and assigned to the Thermo King Corporation. This particular system is preferably powered by liquid carbon dioxide, and includes an evaporator heater coil, an electronically controlled valve for modulating the amount of cryogenic gas that flows through the coil, and a vapor motor driven by the cryogenic gas that flows through the coil. The vapor motor is coupled to both an alternator for recharging the battery, and a fan for generating an air flow through the coil into a conditioned space. To allow the system to be operated in a heating mode, a vaporizer and superheater device is provided for heating the cryogenic gas to approximately 500° F., as well as a set of solenoid operated valves for routing such superheated gas through the evaporator-heater coil in order to either defrost the coil, or heat the conditioned space.

For such a cryogenic refrigeration system to perform effectively, two basic criteria must be fulfilled. First, the system should rapidly achieve its temperature setpoint goal within a conditioned space with the expenditure of only a minimum amount of cryogen, since the amount of cryogen that can be carried in such a system is limited. Secondly, the vapor motor of the system should be operated at sufficiently high speed to insure that the alternator coupled thereto effectively recharges the system battery, and the fan powered by the motor circulates a sufficient amount of air to avoid undesirable temperature nonuniformities throughout the conditioned space.

Clearly, there is a need for a system for controlling such a cryogenic refrigeration system so that only a minimum amount of cryogen is used in achieving the temperature set point within the conditioned space. It would further be desirable if such a system ran the cryogenically powered motor at speeds which were always sufficient for the alternator coupled thereto to adequately recharge the system battery. Such a control system should also be capable of modulating the amount of cryogenic gas entering the vaporizer and superheater device so that the gas exiting the vaporizer coil assembly was always above the freezing point of water, and the gas exiting the superheater gas assembly was approximately 500° F., as the fulfillment of these criteria avoids the formation of unwanted water-ice on the vaporizer coil, and provides adequate heating without adverse metallurgical effects on the evaporator-heater coil. Finally, such a system should be capable of controlling the pressure of the cryogenic gas entering the vapor motor so that no dry ice snow (a form of solid carbon dioxide) is formed in the system which could impair its operation.

SUMMARY OF THE INVENTION

Generally speaking, the invention is a control system for a cryogenic refrigeration system that fulfills all the aforementioned criteria. The control system is particularly adapted for use with a cryogenic refrigeration system of the type having an evaporator-heater coil, an electronically controlled valve for modulating the flow of cryogenic gas to the coil, and a vapor motor powered by cryogenic gas for driving both an alternator for recharging a battery, and a fan for generating a vapor flow through the evaporator-heater coil and into a conditioned space. In its most basic form, the control system comprises a temperature sensor for generating an electrical signal indicative of the temperature of the conditioned space, and a microprocessor electrically connected to the output of the temperature sensor and the alternator and the electronically controlled valve in order to modulate the flow of cryogenic gas through both the evaporator heater coil and the vapor motor to achieve a selected set point temperature in the conditioned space. The microprocessor rectifies the AC output of the alternator and converts this rectified output into shaft rpms of the vapor motor. From the rpms, the microprocessor further computes both the amount of alternator current available for battery recharging and the cfm of air flow generated by the fan. In the event that the available alternator current is insufficient to recharge the battery of the system, or the fan speed is insufficient to circulate a sufficient volume of air, the microprocessor is programmed to increase the motor rpms by opening the electronically controlled valve wider.

The cryogenic refrigeration system may also include a vaporizer and superheater device for heating cryogenic gas circulating through the evaporator-heater coil to the extent necessary to effect either a defrosting operation, or a heating of the conditioned space. The vaporizer and superheating device may include a vaporizer coil assembly for heating the gas above 32° F., and a superheating coil assembly serially connected thereto for superheating the gas to a temperature of approximately 500° F. To insure that the coil assemblies of the vaporizer and superheater device execute their respective functions, the control system may further include first and second temperature sensors for monitoring the temperature of the gas flowing out of the vaporizer and coil heating assemblies, respectively. The outputs of the first and second temperature sensors are connected to the input of the microprocessor, which closes down the electronically controlled valve in the event that the coil assemblies fail to heat the cryogenic gas to their assigned temperatures.

The control system may further include temperature sensors for measuring the inlet and outlet temperatures of the cryogenic gas entering the evaporator-heater coil, as well as sensors for measuring the temperature of the return air entering the vapor motor powered fan.

Finally, in order to insure that dry ice snow does not form within the interior of the vapor motor, the control system may include a pressure sensor for generating electrical signal indicative of the pressure of the cryogen gas entering the motor, as well as a microprocessor controlled back pressure valve for insuring that the pressure of the gas entering the vapor motor is sufficiently high to avoid the formation of dry ice snow.

DETAILED DESCRIPTION OF THE PREFERRED EMBODIMENT

Figure 1:
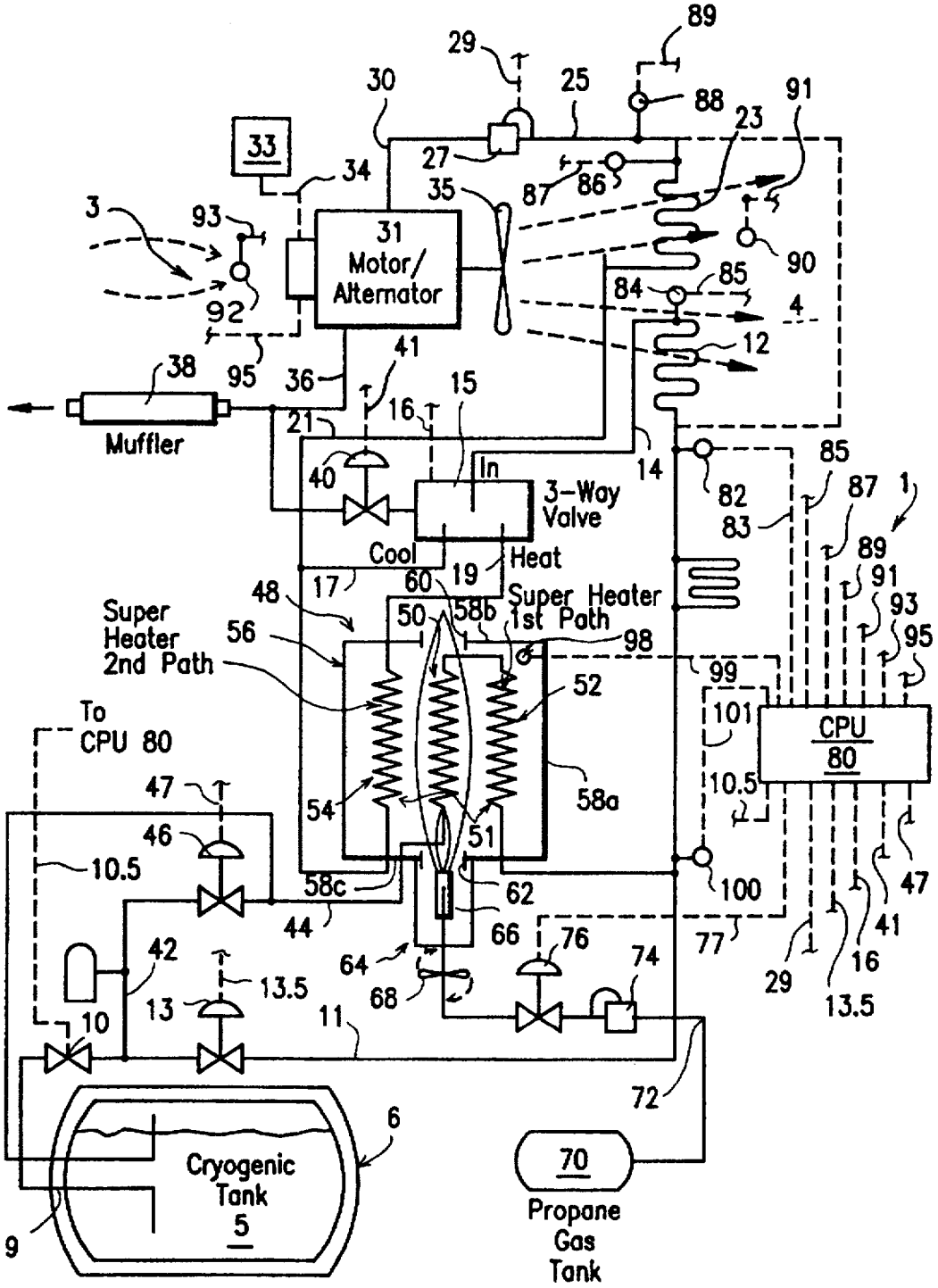

With reference now to FIG. 1, wherein like numerals designate like components throughout both the Figures, the control system 1 is particularly adapted for use with a cryogenic refrigeration system 3 that utilizes a liquid cryogen such as liquid $CO_2$ or liquid nitrogen. While the principal function of the cryogenic refrigeration system 3 is to cool a conditioned cargo space 4, it can also generate heat when necessary to maintain a desired set point temperature within the space 4. To facilitate a better understanding of the function of the control system 1 in the context of such a refrigeration system 3, descriptions of both the refrigeration circuit and the heating circuit of the system 1 will be given. These circuits are also described in U.S. patent application Ser. No. 08/501,372 filed Jul. 12, 1995, and assigned to the Thermo King Corporation, the entire specification of which is hereby incorporated by reference.

The refrigeration circuit of the system 1 begins with a liquid supply line 9 for withdrawing liquid cryogen 5 from the insulated tank 6. The flow of cryogen through line 9 is modulated by an electronic expansion valve 10 that is in turn controlled by a microprocessor 80 via electrical line 10.5 that forms part of the control system 1. Liquid supply line 9 is connected to inlet conduit 11 which introduces liquid cryogen into a first evaporator coil 12 that can also function as a heater coil when the system 1 is switched to a heat mode of operation. A mode valve 13 disposed in the inlet conduit 11 controls the flow of liquid cryogen into the evaporator coil 12, and is normally open during the refrigeration mode of the system 1. Expanding cryogen exiting the first evaporator coil 12 is expelled out of outlet conduit 14 into a three way valve 15. The three way valve 15 has both a cooling outlet 17 and a heating outlet 19, depending upon the mode of operation of the system 1. In the cooling mode of operation, the three way valve 15 routes all of the expanding cryogen it receives from the first evaporator coil 12 through cooling outlet 17, and from thence into the inlet conduit 21 of the second evaporator coil 23. Like the first evaporator coil 12, the second evaporator coil 23 can also be used as a heating coil during the heating mode of the system 1. Because the heating outlet 19 is completely shut off during the cooling mode of operation, virtually none of the expanding cryogen will flow backwards through the conduit 21 into the cryogenic vaporizer and superheater device 1. Expanded cryogen (which is now in a completely gaseous state) exits the outlet conduit 25 of the second evaporator coil 23. Conduit 25 includes a back pressure regulator valve 27 which is modulated by the control system 1 via electrical line 29 to maintain a sufficient back pressure (above 80 psi) in the line to insure that the cryogen remains in a completely gaseous state. Alternatively, back pressure regulator valve may be mechanically operated. This is of particular importance when liquid $CO_2$ is used as the cryogen, since $CO_2$ can coexist in all three phases (i.e., solid, liquid, and gas) under certain temperature and pressure conditions, and since the solid phase can seriously interfere with the operation of the motor/alternator 31. After passing through the back pressure regulator valve 27, the gaseous cryogen enters the previously mentioned motor/alternator 31 via motor inlet conduit 30. The motor/alternator is electrically connected to a battery recharger 33 via electrical line 34.

The heating circuit of the system 3 begins with the cryogen line 42 having an inlet connected to liquid cryogen supply line 9, and an outlet connected to an inlet conduit 44 leading into the vaporizer and superheater device 3 of the invention. A mode valve 46 is positioned between inlet conduit 44 and the cryogenic line 42 for admitting cryogen to the vaporizer and superheater device 48 when the refrigeration system 3 is in a heating mode, whereupon valve 13 is closed to prevent liquid cryogen from flowing into the evaporator coils 12,23.

The vaporizer and superheater device 48 generally comprises a vaporizer coil assembly 50 and a superheating coil assembly 51 which includes first and second superheating coils 52 and 54. While the coils 52 and 54 are shown as being structurally apart from one another in the schematic diagram of FIG. 1 in order to more clearly indicate the flow patterns of the cryogen through the device 1, these coils 52 and 54 are in fact helically intertwined in order to achieve an advantageous compactness. Both the vaporizer coil assembly 50 and the superheating coil assembly 51 are contained within a housing 56 having side, upper and lower insulated walls 58*a,b,c*. The upper wall 58*b* is generally circular in shape, and includes a circular exhaust outlet 60 around its center. The bottom wall 58*c* is likewise circular, and includes a circular flame inlet 62 around its center for receiving the flames of a propane burner 64.

Propane burner 64 is comprised of a combustion nozzle 66, a blower 68 for supplying air for combustion and for directing flames generated by the nozzle 66 into the inlet 62 of the housing 56, and a propane tank 70 for supplying the nozzle 66 with a flow of propane or other fossil fuel. A combustion nozzle 66 and the propane tank 70 are interconnected via fuel line 72, which in turn includes a regulator valve 74 for modulating the flow of propane to the nozzle 66, as well as a fuel shut-off valve 76 for completely stopping a flow of fuel to the nozzle 66. Valve 76 is connected to the control processing unit (CPU) 80 via electrical line 77 as indicated. Turning now to a detailed description of the control system 1, a key component of the system 1 is a central processing unit 80 which may be a Micro P-B microprocessor manufactured by the Thermo King Corporation located in Minneapolis, Minn. The system 1 also includes a coil inlet temperature sensor 82 for measuring the temperature of the refrigerant entering the first evaporator coil 12. The output of the sensor 82 is connected to the input of the CPU 80 via electrical line 83. A coil temperature sensor 84 is provided for measuring the average temperature of the evaporator coils 12,23. The output of sensor 84 is connected to the CPU 80 via electrical line 85. A coil outlet temperature sensor 86 is provided in the system 1 for measuring the temperature of the refrigerant exiting the evaporator coil 23. The output of this sensor 86 is connected to the input of the CPU 80 via electrical line 87. The system 1 also includes a coil outlet pressure sensor 88 for measuring the pressure of the cryogen in the conduit 25. The output of the sensor 88 is connected to the input of the CPU 80 by way of the electrical line 89.

The system 1 also has a discharge air temperature sensor 90 for measuring the temperature of the air discharged into the conditioned space 4. The output of the sensor 90 is connected to the input of the CPU 80 by way of electrical line 91. A return air temperature sensor 92 is provided for measuring the temperature of the air returned from the conditioned space 4. The output of this sensor 92 is transmitted into the input of the CPU 80 through electrical line 93. The AC output connected to the 31 is connected to the input of the CPU by way of electrical line 95 so that the CPU 80 can determine the rpms of the motor/alternator 31. Further, the control system 1 includes both a vaporizer coil assembly temperature sensor 98 and superheating coil temperature sensor 100 whose outputs are connected to the input of the CPU 80 via electrical lines 99 and 101, respectively. The purpose of the sensor 98 is to determine whether or not the cryogen exiting the coil assembly 50 is warm enough to avoid the formation of a film of ice and water on the superheating coils 52,54, while the purpose of the temperature sensor 100 is to determine whether or not the cryogen exiting the first superheating coil 52 is over 500° F.

As has been previously indicated, the input of the CPU 80 of the control system 1 receives information from temperature sensors 82,84,86, pressure sensor 88, temperature sensors 90-and 92, motor/alternator 31 and temperature sensors 98 and 100 via the electrical lines 85,87,89,91,93,95,99, and 101. It proceeds to process this information through an algorithm and controls the positions of the cryogen flow valve 10, the mode valve 13, the three-way valve 15, the back pressure valve 27, the recirculation valve 40, the mode valve 46, and the propane shut-off valve 76 via electrical lines 10.5, 13.5,16,29,41,47, and 77.

When the CPU 80 decides to implement the cooling mode of the refrigeration system 3, it opens mode valve 13 and closes mode valve 46. This action allows cryogen from the tank 6 to enter the first evaporator-heater coil 12 via conduit 11 while preventing the cryogen from entering the vaporizer and superheater device 48 via conduit 44. The CPU 80 further shifts the three-way valve 15 into its "cool" position which allows cryogen exiting the first evaporator-heater coil 12 to recirculate via conduit 17 and 21 into the second evaporator-heater coil 23. Based on the reading of the pressure sensor 88, the CPU proceeds to modulate the position of the back pressure valve 27 so that cryogenic gas exiting the second evaporator-heater coil 23 via conduit 25 will be pressurized to a level prior to entering the motor alternator 21 that will insure that the cryogen is in a completely fluid state (i.e., free of cryogenic snow or other solids). Additionally, the CPU 80 will close recirculation valve 40 so that all of the cryogenic gas passing through the motor/alternator 31 exits the system 3 via conduit 36 and muffler 38. Finally, in this mode of operation, the CPU 80 closes the fuel on/off valve 76 to the vaporizer and superheater device 48 as there is no need to operate the device 48 in this mode. CPU 80 then proceeds to continuously modulate electronic valve 10 to accomplish two objectives, including (1) the achievement and maintenance of a selected temperature setpoint within the conditioned space 4, and (2) the driving of the motor/alternator 31 at a sufficient rpm so that the alternator provides enough current to the battery charger 33 to recharge the system battery (not shown), and the fan 35 drives a sufficient volume of air through the evaporator-heater coils 12,23 to uniformly cool the conditioned space 4.

To achieve the first of these objectives, the CPU constantly monitors the temperature of both the discharge air via sensor 90, the return air via sensor 32, and compares these readouts with the temperature setpoint of the conditioned space 4 selected in its software. In achieving the setpoint goal, CPU 80 follows an algorithm designed to rapidly reach such a setpoint with a minimum expenditure of cryogen while at the same time avoiding unnecessary overshooting or other conditions that could result in destructive top-freezing of items stored within the space 4. In achieving its second goal, it rectifies the AC output of the alternator of the motor/alternator 31 and converts this output into shaft rpms. It then proceeds to compare the actual rpms with the minimum number of rpms necessary to recharge the system battery via recharger 33, and move sufficient air through the evaporator-heater coils 12,23 via fan 35. If the measured rpms is less than the minimum number of rpms necessary to achieve these goals, it incrementally opens electronically controlled valve 10 to a position that ultimately raises the rpms to at least the minimum number.

In operating the system 3 in the heating mode (which may be done to either defrost the evaporator-heater coils 12,23, or to heat the conditioned space 4), the CPU 80 opens fuel valve 76 and proceeds to actuate nozzle 66 of the propane burner 64. It then opens mode valve 46 and closes mode valve 13 so that all of the cryogen exiting the tank 6 flows into the vaporizer and superheater device 48 via conduit 44. The cryogen flowing through conduit 44 first flows through the vaporizer coil assembly 50 and thence into the first superheating coil 52. From thence, the cryogen flows through conduit 11 and into the first vaporizer-heater coil 12. Because the CPU 80 has further switched the position of the three-way valve 15 from "cool" to "heat", cryogenic gas exiting the first coil 12 via conduit 14 is connected to conduit 19 which leads it into the second superheating coil 54. From coil 54, superheated cryogenic gas is led into the second evaporator-heater coil 23 via conduit 21. Cryogenic gas exiting coil 23 drives the motor/alternator 31 via conduits 25 and 30. Finally, instead of directing exhaust drive gas out of the motor/alternator 31 through the muffler 38, the computer opens recirculation valve 40 so that such gas may recirculate through the second superheating coil 54, thereby economizing on the amount of cryogen used to effect the heating mode.

In operating the system 3 in the heating mode, CPU 80 seeks to obtain four objectives, including (1) making sure that the cryogen exiting the vaporizer coil assembly 50 is above freezing; (2) insuring that the cryogen exiting the first superheating coil 52 is on the order of 500° F.; (3) achieving either a temperature on the coils 12,23 sufficient to insure the defrosting of the same, or heating the conditioned space 4 to a temperature setpoint, and (4) driving the shaft of the motor/alternator 31 at a sufficient speed so that the recharger 33 is supplied with enough current to recharge the system battery, and the fan 35 circulates sufficient air in the conditioned space 4 to achieve the selected setpoint. In achieving these goals, the CPU looks to the readout of the temperature sensors 98 (which tells that the temperature of the cryogen exiting the vaporizer coil assembly 50) the temperature sensor 100 (which informs it of the temperature of the cryogen exiting the first superheating coil 52), the temperature sensors 84,86 (which tell that the temperature of the cryogen exiting the coils 12,23), the temperature sensors 90,92 (which tell that the temperature of the discharge air and return air to the conditioned space 4, respectively) and the rectified output of the alternator of the motor/alternator 31 (which may be converted into motor shaft rpms. It then modulates the valve 10 to insure that the flow of cryogen entering the vaporizer and superheater device 48 is sufficient to achieve all of the aforementioned objectives.

What is claimed:

1. A control system for a cryogenic refrigeration system of a type having an evaporator-heater coil, an electronically controlled valve for regulating an amount of cryogenic gas to said evaporator-heater coil, a vapor motor driven by said cryogenic gas coupled to both an alternator for recharging a battery, and a fan for generating an air flow through said coil and into a conditioned space, comprising:

a temperature sensing means for generating an electrical signal indicative of the temperature of said conditioned space, and a microprocessor means having an input electrically connected to said temperature sensing means and the electrical output of said alternator and an output electrically connected to said electronically controlled valve for modulating the flow of cryogenic gas through said coil and said motor to achieve a selected set point temperature in said conditioned space.

2. The control system of claim 1, wherein said microprocessor means converts a rectified output of said alternator into shaft rpms of said vapor motor, and computes both the amount of alternator current available for battery recharging and the cfm of air flow generated by said fan.

3. The control system of claim 2, wherein said cryogenic refrigeration system further has a back pressure valve for controlling the pressure of the cryogenic gas entering the vapor motor for maintaining said gas pressure above a selected value to avoid the formation of dry ice snow in said motor.

4. The control system of claim 3, wherein said back pressure valve is electrically operated, and wherein said output of said microprocessor means is electrically connected to said back pressure valve.

5. The control system of claim 3, wherein said back pressure valve is mechanically operated.

6. The control system of claim 2, further comprising a first refrigerant temperature sensing means for generating an electrical signal indicative of the temperature of the cryogen entering said coil that is electrically connected to the input of said microprocessor means.

7. The control system of claim 4, further comprising a second refrigerant temperature sensing means for generating an electrical signal indicative of the temperature of the cryogen leaving said coil that is electrically connected to the input of said microprocessor means.

8. The control system of claim 3, further comprising a pressure sensing means for generating an electrical signal indicative of the pressure of the cryogen leaving the coil and entering the vapor motor that is electrically connected to the input of said microprocessor means.

9. The control system of claim 2, further comprising a temperature sensing means for generating an electrical signal indicative of the temperature of air entering said fan that is electrically connected to the input of said microprocessor means.

10. The control system of claim 1, wherein heating said cryogenic refrigeration system further has a heating device including a first coil assembly for vaporizing said cryogen and a second coil assembly for superheating said cryogen to cause said evaporator-heater coil to radiate heat.

11. The control system of claim 10, further comprising a temperature sensor for generating an electrical signal indicative of the temperature of the cryogen leaving said first coil assembly that is electrically connected to the input of the microprocessor means, wherein said microprocessor means modulates the flow of cryogen entering said heating device such that the temperature of the cryogen leaving said first coil assembly is over 32° F.

12. The control system of claim 10, further comprising a temperature sensor for generating an electrical signal indicative of the temperature of the cryogen leaving said second coil assembly that is electrically connected to the input of the microprocessor means, wherein said microprocessor means modulates the flow of cryogen entering said heating device such that the temperature of the cryogen leaving said second coil assembly is about 500° F.

13. A control system for a cryogenic refrigeration system of a type having an evaporator-heater coil, an electronically controlled valve for regulating an amount of cryogenic gas to said evaporator-heater coil, a vapor motor driven by said cryogenic gas coupled to both an alternator for recharging a battery, and a fan for generating an air flow through said coil and into a conditioned space, comprising:

a temperature sensing means for generating an electrical signal indicative of the temperature of said conditioned space, and a microprocessor means having an input electrically connected to said temperature sensing means and the electrical output of said alternator and an output electrically connected to said electronically controlled valve for both converting a rectified output of said alternator into shaft rpms of said fan and modulating the flow of cryogenic gas through said coil and said motor via said electronically controlled valve to achieve a selected set point temperature in said conditioned space.

14. The control system of claim 13, wherein said cryogenic refrigeration system further has an electronically operated back pressure valve for controlling the pressure of the cryogenic gas entering the vapor motor, and a pressure sensing means for generating an electrical signal indicative of the pressure of the cryogen leaving the coil and entering the vapor motor that is electrically connected to said microprocessor means, and wherein said output of said microprocessor means is electrically connected to said back pressure valve for maintaining said gas pressure above a selected value to avoid the formation of dry ice snow in said motor.

15. The control system of claim 13, wherein said cryogenic refrigeration system further comprises a heating device for heating said cryogen into a superheated gas, and valve means for routing said cryogen to said evaporator heater coil via said heating device.

16. The control system of claim 15, wherein said heating device includes a first coil assembly for heating said cryogenic gas to above freezing and a second coil assembly for superheating said cryogenic gas, and said system includes first and second temperature sensors located downstream of said first and second coil assemblies for generating electrical signals indicative of the temperature of the gas exiting said first and second coil assemblies, respectively.

17. The control system of claim 16, wherein said microprocessor means is electrically connected to the outputs of said first and second temperature sensors, and modulates a flow of cryogenic gas via said electronically controlled valve to achieve a selected set point temperature in said conditioned space.

18. The control system of claim 13, further comprising a first refrigerant temperature sensing means for generating an electrical signal indicative of the temperature of the cryogen entering said coil that is electrically connected to the input of said microprocessor means.

19. The control system of claim 17, further comprising a second refrigerant temperature sensing means for generating an electrical signal indicative of the temperature of the cryogen leaving said coil that is electrically connected to the input of said microprocessor means.

20. The control system of claim 13, further comprising a temperature sensing means for generating an electrical signal indicative of the temperature of air entering said fan that is electrically connected to the input of said microprocessor means.

* * * * *